US006852174B2

(12) United States Patent
Takemoto et al.

(10) Patent No.: US 6,852,174 B2
(45) Date of Patent: Feb. 8, 2005

(54) POWDER MAGNETIC CORE

(75) Inventors: Satoshi Takemoto, Ichinomiya (JP); Takanobu Saito, Okazaki (JP)

(73) Assignee: Daido Tokushuko Kabushiki Kaisha, Nagoya (JP)

( * ) Notice: Subject to any disclaimer, the term of this patent is extended or adjusted under 35 U.S.C. 154(b) by 247 days.

(21) Appl. No.: 10/217,003

(22) Filed: Aug. 12, 2002

(65) Prior Publication Data

US 2003/0047245 A1 Mar. 13, 2003

(30) Foreign Application Priority Data

Aug. 15, 2001 (JP) ..... 2001-246614
Apr. 12, 2002 (JP) ..... 2002-111007

(51) Int. Cl.[7] ..... H01F 1/08

(52) U.S. Cl. ..... 148/306; 148/307; 148/309; 75/228; 75/230; 75/231; 75/246; 252/62.55

(58) Field of Search ..... 148/104, 108, 148/306, 307, 309; 75/228, 230, 231, 246; 252/62.55

(56) References Cited

U.S. PATENT DOCUMENTS 4,985,089 A * 1/1991 Yoshizawa et al. ..... 148/303
5,178,689 A * 1/1993 Okamura et al. ..... 148/306
5,252,148 A * 10/1993 Shigeta et al. ..... 148/307
5,993,569 A * 11/1999 Simon et al. ..... 148/307
6,419,760 B1 * 7/2002 Takemoto et al. ..... 148/306

* cited by examiner

*Primary Examiner*—John P Sheehan
(74) *Attorney, Agent, or Firm*—Frishauf, Holtz, Goodman & Chick, P.C.

(57) ABSTRACT

There is disclosed a powder magnetic core in which a permeability does not easily drop even when an applied magnetic field intensifies, comprising: a bulk body containing a main component of a powder of an Fe-base alloy having a soft magnetic property, and the balance substantially including a heat-treated insulation binder and a void, wherein an aspect ratio of the powder is in a range of 1 to 1.5, and a volume ratio of the powder in the bulk body is in a range of 40 to 60 volume %, and an initial permeability ($\mu_0$) has a value which satisfies $6 \leqq \mu_0 \leqq 20$, and a relation of $\mu/\mu_0 \geqq 0.5$ is established between K and A, when the permeability is $\mu$ with an applied magnetic field of 24 kA/m.

1 Claim, 1 Drawing Sheet

FIGURE
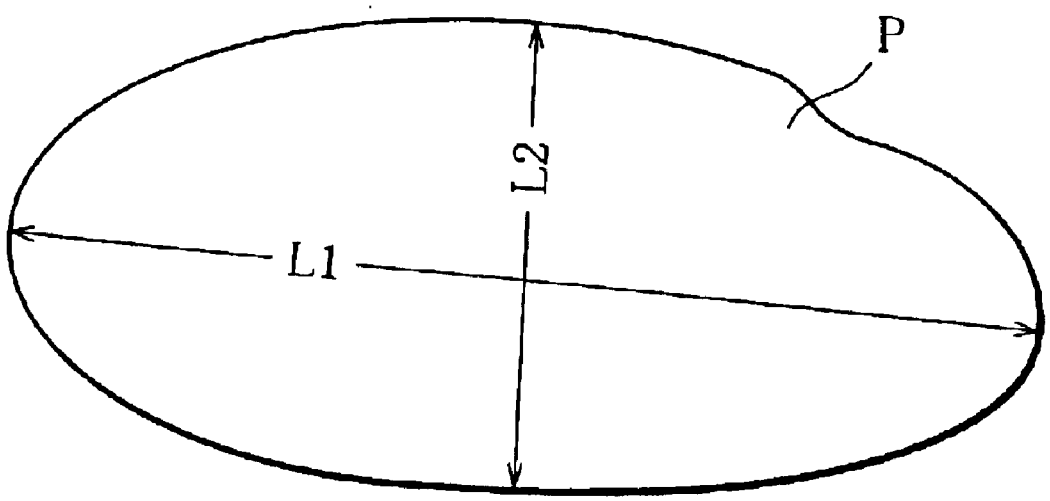

POWDER MAGNETIC CORE

BACKGROUND OF THE INVENTION

1. Field of the Invention

The present invention relates to a powder magnetic core, particularly to a powder magnetic core whose initial permeability is lowered, which therefore indicates a high permeability even with application of a high magnetic field, and which exerts a superior direct-current superimposition property as a result.

2. Prior Art

A powder magnetic core can be manufactured with a high yield, even when an object product has a small size and complicated shape. Therefore, the core has been started to be broadly used instead of a laminated magnetic core using a silicate steel plate, which is a mainstream of a conventional magnetic core. Specifically, the core is used, for example, in a core of a transformer for charging a battery mounted on an electric car or a hybrid car, an inductor to be used in an unstop power source (UPS), and the like.

The powder magnetic core is generally manufactured in a manner as follows.

First, a soft magnetic alloy having a predetermined composition is subjected to a mechanical grinding or an atomization process and a powder having a predetermined grain size distribution (hereinafter referred to as a soft magnetic powder) is manufactured.

Subsequently, the soft magnetic powder is homogeneously mixed with a predetermined amount of an insulation material and binder component. This treatment is performed in order to raise an electric resistivity of the powder magnetic core to be manufactured. Examples of the insulation material to be used in this case include: oxide powders such as an $Al_2O_3$ powder, and $SiO_2$ powder; and nitride powders such as AlN, $Si_3N_4$, and BN. Moreover, examples of the binder component include water glass also having an electric insulation property, and organic polymers such as silicone resin.

Additionally, in the following description, the above-described insulation material and binder component will collectively be referred to as "an insulation bindery".

Subsequently, the mixture is charged into a mold, and molded with a predetermined pressure so that a green compact of the powder magnetic core is manufactured. Additionally, in this case, to enhance a molding property, usually a predetermined amount of lubricants such as zinc stearate is further mixed into the above-described mixture.

Finally, the green compact is heat-treated, a molding strain accumulated during molding is released, and a targeted powder magnetic core is obtained.

The powder magnetic core manufactured in this manner, in general, as a direct-current magnetic field (applied magnetic field) intensifies, gradually increases its magnetic flux density and when the applied magnetic field reaches a certain intensity, its magnetic flux density is saturated. Such magnetization curve (B-H curve) is drawn.

Furthermore, the permeability in the magnetic field (differential specific permeability) is defined with a value obtained by superimposing an alternating-current micro magnetic field upon a certain direct-current magnetic field, slightly changing the magnetic field, and dividing an obtained change amount of the magnetic flux density by a micro change amount of the magnetic field in the process of the increase of the magnetic flux density. Therefore, when an inclination of the B-H curve is reduced, that is, when the applied magnetic field is intensified, the differential specific permeability is reduced. Therefore, the permeability decreases. When and after reaching saturation magnetization, the permeability substantially indicates 1.

Additionally, with the high-permeability powder magnetic core manufactured using soft magnetic powders such as a Sendust powder as a raw material, when the core is used by conduction of a large current, an intense direct-current magnetic field is applied to the core. Therefore, the magnetic flux density of the powder magnetic core rapidly approaches the saturation. As a result, the permeability decreases toward 1. That is, the powder magnetic core having such high permeability is inferior in the direct-current superimposition property.

Usually, in a use field of the powder magnetic core, the powder magnetic core whose initial permeability is about 60 to 125 in practically used. However, with the powder magnetic core having such initial permeability, for example, when a high magnetic field of 16 kA/m or more is applied, the permeability becomes remarkably low, which gives rise to a problem that the core cannot bear its practical use. Particularly, in recent years, the electric car, hybrid car, and the like have been driven with an increasingly large current. Accordingly, the magnetic field applied to the mounted core tends to increase. Therefore, there has been a demand for a capability of the powder magnetic core which can bear a large-current use.

Therefore, for example, even when a high magnetic field of 16 kA/m or more is applied, in order to suppress deterioration of the direct-current superimposition property in a state where a necessary level of permeability is secured, it is effective to lower the initial permeability of the powder magnetic core to be used.

Moreover, it is generally known that the permeability is a function of density of the powder magnetic core. That is, the powder magnetic core having a low density indicates a low permeability. In consideration of this, in order to achieve the above object of lowering the initial permeability of the powder magnetic core, it is effective to lower the density of the powder magnetic core.

However, even in this case, it should be considered that the powder magnetic core has a magnetic property that the magnetic flux density of the powder magnetic core increases as the applied magnetic field intensifies, and finally reaches saturation magnetization. Moreover, even if the initial permeability is low, a saturation magnetic flux density of the powder magnetic core has to satisfy the necessary level for practical use. Another point is that the core should be able to be manufactured industrially with high yield.

OBJECT AND SUMMARY OF THE INVENTION

An object of the present invention is to provide a powder magnetic core developed from the above-described viewpoint, and to provide a novel powder magnetic core whose permeability does not easily drop even with application of a high magnetic field, and which can be used practically until reaching high applied magnetic field.

To achieve the above-described object, according to the present invention, the re is provided a powder magnetic core, comprising:

a bulk body containing a main component of a powder of an Fe-based alloy having a soft magnetic property, and the balance substantially including an insulation binder and a void, wherein an aspect ratio of the powder is in a range of 1 to 1.5, and a volume ratio of the powder in the bulk body is in a range of 40 to 60%, and an initial permeability ($\mu_0$) has a value which satisfies $6 \leqq \mu_0 \leqq 20$, and a relation of $\mu/\mu_0 \geqq 0.5$ is established between $\mu_0$ and $\mu$, when the permeability is $\mu$ with an applied magnetic field of 24 kA/m.

BRIEF DESCRIPTION OF THE DRAWINGS

FIGURE is a plan view of a soft magnetic powder, showing definition of a long axis $L_1$ and short axis $L_2$ for calculating an aspect ratio.

DETAILED DESCRIPTION OF THE INVENTION

A powder magnetic core of the present invention is a bulk body which is manufactured by molding a mixture of a soft magnetic powder having a shape property described later and an insulation binder described later, and further heat-treating the formed material, and which has a certain density.

During the heat treatment, the components of the green compact change as follows:

The insulation binder changes due to heat as follows:

For example, in the case of water glass, water contained in it is lost, so that the water glass decreases in weight and volume. In the case of an organic polymer, it is thermally decomposed, and decreases in weight and volume. In an extreme case, nothing but residuals remains.

In contrast, the soft magnetic powder does not change in quality with the heat treatment. It does not decrease in weight or volume.

Thus, in the manufactured bulk body, the soft magnetic powder is in the same state as it was at the beginning of the manufacturing, not having changed in quality during the manufacturing. Also the weight and volume of the soft magnetic powder remain unchanged.

In contrast, the insulation binder has changed in quality due to heat. For example, after the heat treatment, the water glass is no longer water glass, and the organic polymer is no longer an organic polymer. Further, the weight of such component has decreased, and the volume thereof has much decreased as compared with its volume at the beginning of the manufacturing.

Further, an appropriate amount of voids have formed in the bulk body.

Therefore, the powder magnetic core has a skeleton structure in which the soft magnetic powder is coated with the heat-treated insulation binder and the soft magnetic powders are bonded to one another by the heat-treated insulation binder, and the core has a texture structure in its interior in which micro holes as voids are distributed.

Moreover, in the powder magnetic core of the present invention, in the above-described texture structure, a volume ratio of the soft magnetic powder in the whole volume of the bulk body is set to a range of 40 to 60 volume %. Therefore, a ratio of a volume combining the balance of a component mainly containing the insulation binder and a volume of the voids consisted of micro holes is in a range of 40 to 60 volume % with respect to the whole volume of the bulk body.

First, for the powder magnetic core of the present invention, assuming that an initial permeability of the core is $\mu_0$, $\mu_0$ indicates a value which satisfies $6 \leqq \mu_0 \leqq 20$. Furthermore, assuming that the permeability is $\mu$ during the magnetic field of 24 kA/m to the powder magnetic core, the core has a magnetic property such that a relation of $\mu/\mu_0 \geqq 0.5$ is established between $\mu_0$ and $\mu$.

That is, in the powder magnetic core of the present invention, although the initial permeability $\mu_0$ indicates a low value, reduction of the permeability is small even with the application of the high magnetic field. Specifically, even when a high magnetic field of 24 kA/m is applied, the permeability ($\mu$) of 50% or more is secured at that time with respect to the initial permeability ($\mu_0$) in the powder magnetic core.

The relation of $6 \leqq \mu_0 \leqq 20$ is essential for realizing the relation of $\mu/\mu_0 \geqq 0.5$. When the initial permeability ($\mu_0$) deviates from this range, $\mu/\mu_0$ becomes less than 0.5. That is, $\mu$ remarkably drops, and cannot be used practically.

The magnetic property defined in the present invention can be realized by satisfying requirements described later.

In this case, it is necessary to use the soft magnetic powder whose aspect ratio described later is in a range of 1 to 1.5.

With the soft magnetic powder whose aspect ratio is larger than 1.5, a diamagnetic coefficient of the powder becomes small, and the initial permeability ($\mu_0$) of the manufactured powder magnetic core becomes high. As a result, when the high magnetic field is applied, the permeability drops. Specifically, the relation of $\mu/\mu_0 \geqq 0.5$ cannot be established.

It should be noted that the aspect ratio mentioned in the present invention indicates a value measured as follows.

$$\text{Aspect ratio} = L_1/L_2$$

Here, $L_1$ is defined as a long axis length observed from a powder P as shown in the FIGURE, while $L_2$ is defined as a short axis length obtained by a line passing through a midpoint of $L_1$, extending vertical to the long axis $L_1$, and crossing an outer periphery of the powder.

Therefore, the aspect ratio of 1 indicates that the powder has a spherical shape, and the aspect ratio will not be calculated as a value smaller than 1.

It should be noted that the soft magnetic powder to be used in the present invention may be any powder as long as the powder is a powder of an Fe-based alloy having a soft magnetic property and has the above-described shape property.

In this case, examples of the Fe-based alloy include Fe-3% Si, Fe-6.5% Si, Fe-9.5% Si-5.5% Al (Sendust), Fe-47% Ni, Fe-(1 to 18)% Cr alloy (% indicates mass %), and the like.

In the powder magnetic core of the present invention, a volume ratio of the powder having such a shape property to the whole bulk body is regulated in a range of 40 to 60 volume %. This regulation is essential for realizing the relation of $6 \leqq \mu_0 \leqq 20$.

When the above volume ratio is larger than 60 volume %, the initial permeability ($\mu_0$) of the powder magnetic core exceeds 20 and becomes high. As a result, when the high magnetic field is applied, the permeability ($\mu$) drops. Specifically, the relation of $\mu/\mu_0 \geqq 0.5$ cannot be established.

Moreover, when the volume ratio is smaller than 40 volume %, a relative ratio of components such as the insulation binder described later increases, and at same time the whole volume of micro holes also increases. Therefore, for the magnetic property, the initial permeability ($\mu_0$) drops to be less than 6. Furthermore, a saturation magnetic flux density also drops, and at the same time a direct-current superimposition property is also deteriorated, and therefore the permeability ($\mu$) during the application of the high magnetic field also drops. That is, similarly as described above, the relation of $\mu/\mu_0 \geqq 0.5$ cannot be established.

Additionally, since the powder magnetic core is entirely and relatively porous, it cannot be said that a sufficient intensity property is secured.

Moreover, the insulation binder is not particularly limited as the insulation binder usable in the present invention, and examples thereof include conventional binders such as water glass, silicone resin, phosphoric acid, phenol resin, and imide resin.

The amount of the insulation binder to be used is preferably set to 5 to 25 parts by mass with respect to 100 parts by mass of the soft magnetic powder. This value is a very large amount compared with the conventional powder magnetic core.

When a large amount of insulation binder is contained in the bulk body in this manner, the density of powder magnetic core of the present invention becomes low. As a result, the value of the initial permeability ($\mu_0$) becomes small.

When the content of the insulation binder is smaller than 5 parts by mass, the density of the powder magnetic core is insufficiently reduced, and the initial permeability ($\mu_0$) increases. Therefore, the permeability ($\mu$) during the application of the high magnetic field possibly drops. Specifically, it is difficult to establish the relation of $\mu/\mu_0 \geqq 0.5$.

Moreover, when the content is larger than 25 parts by mass, the density of the powder magnetic core can be reduced, and the initial permeability ($\mu_0$) can be reduced. However, on the other hand, since the volume ratio of the soft magnetic powder is reduced, it is difficult to obtain, for example, the targeted saturation magnetic flux density. Moreover, phenomena such as breakage occur during molding and a generation ratio of defects increases.

Similarly as the conventional method, the powder magnetic core of the present invention can be manufactured by mixing the above-described components, molding the mixture, and subsequently subjecting the mixture to a heat treatment.

Additionally, in the molding step, the mixture is preferably molded with a relatively low pressure in order to increase a void ratio, and it is preferable to use a molding pressure, for example, in a range of 100 to 1000 MPa.

EXAMPLES

Examples 1 to 13, Comparative Examples 1 to 7

Various types of soft magnetic powders having component compositions and aspect ratios shown in Table 1 were manufactured by an atomization method and with a particle diameter of 100-mesh (150 $\mu$m) or less.

Subsequently, water glass was added/mixed in a range of 4 to 20 parts by mass with respect to 100 parts by mass of these powders, and further 0.5 part by mass of zinc stearate (lubricant) was mixed.

Each mixture was press-molded with a pressure of 98 to 686 Mpa to obtain an annular powder compact having an outer diameter of 28 mm, inner diameter of 20 mm, and thickness of 5 mm, then magnetic annealing was performed in an Ar atmosphere at a temperature of 650° C. held for one hour in order to remove strains, and various types of powder magnetic cores having different volume ratios of the soft magnetic powders were prepared as shown in Table 1.

Properties of the obtained powder magnetic cores were checked according to the following specifications.

(1) Volume ratio (volume %) of soft magnetic powder:

Each powder magnetic core was cut at random to show four cross-sections. The four cross-sections were photographed, and image analysis was performed on each of the four photographs. For each cross-section, the area ratio of soft magnetic powder was measured. Then, the average area ratio was obtained by adding the four area ratios obtained from the four photographs and dividing the total by four.

Last, the average area ratio was converted into the volume ratio using the following conversion equation:

$$\text{Volume ratio (volume \%)} = (\text{Area ratio})^{3/2}$$

(2) Initial permeability ($\mu_0$): Each powder magnetic core was wound with 350 turns of line, and a specific permeability was measured using 42841A precision LCR meter manufactured by YHP Co., when an alternating-current magnetic field with the applied magnetic field of 0.4 A/m and a frequency of 20 kHz was applied.

(3) Permeability ($\mu$) with the applied magnetic field of 24 kA/m: The LCR meter was used, and the permeability was measured as a differential specific permeability, when the alternating-current magnetic field with the applied magnetic field of 0.4 A/m and a frequency of 20 kHz was superimposed upon the direct-current magnetic field with the applied magnetic field of 24 kA/m.

The above-described results are collectively shown in Table 1.

TABLE 1

| | Powder magnetic core | | | Magnetic property | | |
|---|---|---|---|---|---|---|
| | | | | | Permeability | |
| | Sorts of powder | Aspect ratio of powder | Ratio of Powder (volume %) | Initial permeability | $\mu$ with applied magnetic field of 24 kA/m | $\mu/\mu_0$ |
| Example 1 | Fe—9.5%Si—5.5%Al | 1.1 | 56 | 18 | 11.5 | 0.64 |
| Example 2 | | 1.1 | 54 | 14 | 10.5 | 0.75 |
| Example 3 | | 1.1 | 52 | 10 | 8 | 0.80 |
| Example 4 | | 1.1 | 47 | 8 | 7 | 0.88 |
| Example 5 | | 1.1 | 41 | 6 | 5 | 0.83 |
| Example 6 | | 1.3 | 52 | 12 | 9 | 0.75 |
| Example 7 | | 1.4 | 52 | 14 | 8 | 0.57 |
| Comp. ex. 1 | | 1.1 | 64 | 22 | 10 | 0.45 |
| Comp. ex. 2 | | 1.1 | 35 | 4 | 1.5 | 0.38 |
| Comp. ex. 3 | | 1.7 | 52 | 28 | 11 | 0.39 |
| Comp. ex. 4 | | 1.7 | 42 | 18 | 10.5 | 0.33 |

TABLE 1-continued

| | Powder magnetic core | | | Magnetic property | | |
|---|---|---|---|---|---|---|
| | | | | | Permeability | |
| | Sorts of powder | Aspect ratio of powder | Ratio of Powder (volume %) | Initial permeability | $\mu$ with applied magnetic field of 24 kA/m | $\mu/\mu_0$ |
| Example 8 | Fe—6.5%Si | 1.1 | 54 | 14 | 11 | 0.79 |
| Example 9 | | 1.1 | 52 | 10 | 8.5 | 0.85 |
| Example 10 | | 1.3 | 52 | 12 | 9 | 0.75 |
| Comp. ex. 5 | | 1.1 | 64 | 22 | 10.5 | 0.48 |
| Comp. ex. 6 | | 1.1 | 35 | 4 | 1.5 | 0.38 |
| Comp. ex. 7 | | 1.7 | 52 | 28 | 12 | 0.43 |
| Example 11 | Fe—3%Si | 1.1 | 52 | 10 | 9 | 0.90 |
| Example 12 | Fe—47%Ni | 1.1 | 52 | 10 | 8.5 | 0.85 |
| Example 13 | Fe—12%Cr | 1.1 | 52 | 10 | 8 | 0.80 |

Table 1 clarifies the following points.

(1) In Comparative Examples 1, 5 in which the volume ratio of the soft magnetic powder is larger than the range defined in the present invention, the initial permeability ($\mu_0$) becomes higher than the range defined in the present invention. As a result, the degree of drop of the permeability during the application of the high magnetic field increases, and the $\mu/\mu_0 \geqq 0.5$ defined in the present invention cannot be satisfied. Moreover, in Comparative Examples 2, 6 in which the volume ratio of the soft magnetic powder is smaller than the range defined in the present invention, the initial permeability is lower than the range defined in the present invention, and the degree of the drop of the permeability is similarly large. Therefore, it is understood that the volume ratio of the soft magnetic powder should be set in a range of 40 to 60 volume %.

(2) As apparent from comparison of Example 7 with Comparative Example 3, and Example 10 with Comparative Example 7, even when the cores are manufactured using the same materials and with the same requirements, Comparative Examples 3, 7 having the aspect ratios deviating from the range defined in the present invention have a higher initial permeability as compared with Examples 7, 10. The permeability during the application of the high magnetic field drops. This shows that the aspect ratio of the soft magnetic powder to be used should be set in a range of 1 to 1.5.

(3) For Examples 1 to 13 having the volume % of the soft magnetic powder and aspect ratios in the range defined in the present invention, the initial permeability is in a range of 6 to 20 irrespective of the types of materials. The drop of the permeability in the application of the high magnetic field is suppressed, and the relation of $\mu/\mu_0 \geqq 0.5$ is established.

As apparent from the above description, the initial permeability of the powder magnetic core according to the present invention is set to be low. However, when the high magnetic field is applied, the drop of the permeability is suppressed.

Therefore, the powder magnetic core is useful for applications such as a choke coil for a large current or an inductor mounted in an electric car, hybrid car, unstop power source (UPS), and the like.

What is claimed to:

1. A powder magnetic core, comprising:

a bulk body containing a main component of a powder of an Fe-base alloy having a soft magnetic property, and the balance including a heat-treated insulation binder and a void, wherein an aspect ratio of said powder is in a range of 1 to 1.5, and a volume ratio of said powder in said bulk body is in a range of 40 to 60 volume %, and an initial permeability ($\mu_0$) has a value which satisfies $6 \leqq \mu_0 \leqq 20$, and a relation of $\mu/\mu_0 \geqq 0.5$ is established between $\mu_0$ and $\mu$, when the permeability is $\mu$ with an applied magnetic field of 24 kA/m.

* * * * *